US005175895A

United States Patent [19]

Fike et al.

[11] Patent Number: 5,175,895

[45] Date of Patent: Jan. 5, 1993

[54] FLAPPER VALVE MOUNTING ADAPTER

[76] Inventors: Jeffrey R. Fike, 9045 W. Arizona Dr., Lakewood, Colo. 80226; John A. Fernstrum, Jr., 4802 N. 12th St., Apt. 2033, Phoenix, Ariz. 85014

[21] Appl. No.: 515,861

[22] Filed: Apr. 27, 1990

[51] Int. Cl.[5] ..... E03D 1/35

[52] U.S. Cl. ..... 4/393

[58] Field of Search ..... 4/392, 393, 403, 404

[56] References Cited

U.S. PATENT DOCUMENTS

| | | | |
|---|---|---|---|
| D. 248,313 | 6/1978 | Henry | D23/1 |
| D. 248,404 | 7/1978 | Henry | D23/1 |
| 1,233,684 | 7/1917 | Meyer et al. . | |
| 2,883,675 | 4/1959 | Hartman | 5/57 |
| 3,167,787 | 2/1965 | Connealy | 4/58 |
| 3,324,482 | 6/1967 | Wustner | 4/57 |
| 3,331,084 | 7/1967 | Wustner | 4/57 |
| 3,590,395 | 7/1971 | Wustner | 4/56 |
| 3,599,247 | 8/1971 | Kamphausen | 4/393 |
| 3,702,012 | 11/1972 | Bennett | 4/392 |
| 3,707,733 | 1/1973 | Gore et al. | 4/393 |
| 3,812,545 | 7/1974 | Lanahan | 4/67 |
| 3,858,250 | 1/1975 | Coglitore | 4/67 |
| 3,955,218 | 5/1976 | Ramsey | 4/56 |
| 4,000,526 | 1/1977 | Bieia et al. | 4/57 |
| 4,149,283 | 4/1979 | Kundtson | 4/324 |
| 4,160,294 | 7/1979 | Crumby | 4/393 |
| 4,189,795 | 2/1980 | Conti et al. | 4/324 |
| 4,497,076 | 2/1985 | Sullivan | 4/392 |
| 4,698,859 | 10/1987 | Freed | 4/393 |

*Primary Examiner*—Charles E. Phillips
*Attorney, Agent, or Firm*—Gregory J. Nelson

[57] ABSTRACT

An adapter for mounting, via trunnions, a flapper valve upon a pair of uprights extending from a valve seat of a discharge pipe in a toilet tank.

18 Claims, 1 Drawing Sheet

FLAPPER VALVE MOUNTING ADAPTER

BACKGROUND OF THE INVENTION

1. Field of the Invention

The present invention relates to mountings for toilet tank flapper valves and, more particularly, to an adapter for pivotally supporting a replacement flapper valve.

2. Description of the Prior Art

For years, a number of companies have provided ball valves or flapper valves for use in toilet tanks to control water flow into the discharge pipe. These flapper valves are usually pivotally mounted to a stand pipe having pins or trunnions extending therefrom. A secondary market exists for providing replacement flapper valves which are other than the original equipment supplied by the original source or manufacturer. These flapper valves, which may have many different configurations, have arms extending therefrom for pivotally engaging the pins or trunnions.

In certain installations, the stand pipe does not include pins or trunnions for mounting a flapper valve. To meet this contingency, collar like devices have been developed for circumscribingly engaging the stand pipe. These collars include pins or trunnions for mounting replacement flapper valves.

A major supplier, American Standard, of original equipment for use in toilet tanks has developed a specially configured valve assembly for controlling water outflow through the discharge pipe. This assembly is mounted on or in conjunction with the upper end of the discharge pipe within the toilet tank. The assembly includes a conventional stand pipe attached to a ring serving as a valve seat in alignment with the discharge outlet. A pair of uprights extend upwardly from the ring to support the ball or flapper valve. These uprights are sufficiently close to the valve seat to preclude effective use of most after market replacement flapper valves which might be mountable upon the stand pipe. Accordingly, replacements for the flapper valve and its related structure must be obtained from American Standard. Because after market flapper valves cannot be used effectively and as the source of replacement parts is exclusive with the manufacturer, the costs attendant replacement/repair are relatively high.

SUMMARY OF THE INVENTION

An adapter includes a pair of slots for receiving a correspondingly sized pair of uprights extending from a valve seat attendant the discharge outlet in a toilet tank. The adapter penetrably receives the uprights and is firmly held in place by them. A pair of trunnions extend in opposed directions from opposed sides of the adapter to receive, retain and pivotally support apertured arms of a replacement flapper valve.

It is therefore a primary object of the present invention to provide an adapter for pivotally mounting a flapper valve.

Another object of the present invention is to provide a mounting adapted to a particular environment for pivotally mounting a flapper valve.

Yet another object of the present invention is to provide a mounting for replacement flapper valves adapted for seating upon any of a family of paired uprights.

Still another object of the present invention is to provide a replacement flapper valve mounting for an American Standard type ball valve assembly.

A further object of the present invention is to provide an adapter attachable to the ball valve mounting of an American Standard ball valve toilet tank assembly.

A yet further object of the present invention is to provide a pair of flapper valve supporting trunnions mounted upon the uprights of a ball valve supporting assembly.

A still further object of the present invention is to provide an adapter for mounting a flapper valve upon an American Standard ball valve seat in a toilet tank.

These and other objects of the present invention will become apparent to those skilled in the art as the description thereof proceeds.

BRIEF DESCRIPTION OF THE DRAWINGS

The present invention will be described with greater clarity and specificity with reference to the following drawings, in which.

DESCRIPTION OF THE PREFERRED EMBODIMENT

Various companies make ball valves or flapper valve assemblies for mounting upon or attachment to the discharge pipe at the bottom of a toilet tank. Often, these assemblies define the discharge outlet and include a valve seat for cooperative engagement by the associated flapper valve. From time to time, the flapper valve must be replaced due to damage or general deterioration. A substantial after market exists for replacement flapper valves to be installed by either plumbers or homeowners. A company known in the trade as American Standard provides a flapper valve (sometimes referred to as a disc cylinder valve) assembly which does not permit use of the generally available after market replacement flapper valves. The primary inhibiting element is a pair of uprights extending from a location very close to the valve seat itself. These uprights tend to interfere with an after market flapper valve pivotally attached to an accompanying stand pipe. Accordingly, the specially configured flapper valve mated with the American Standard flapper valve assembly must be purchased for replacement purposes.

Figure 1:
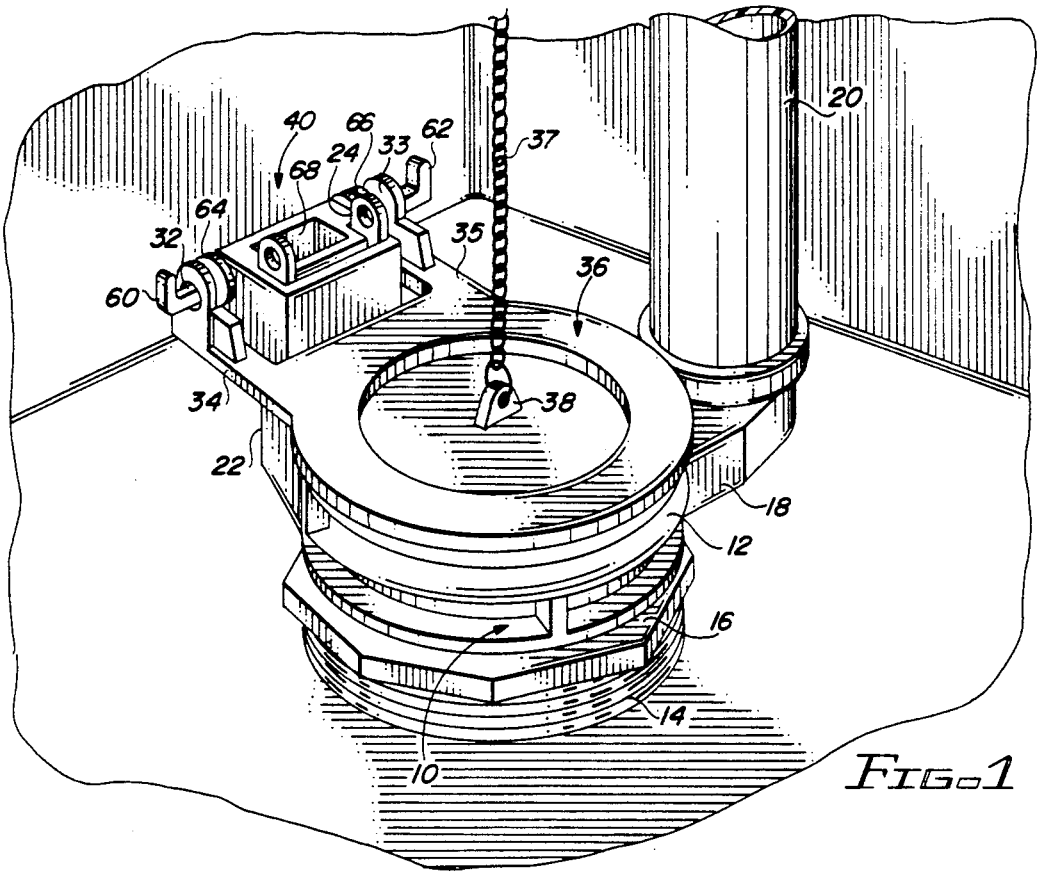
FIG. 1 is a perspective view illustrating operation of the adapter.
Figure 2:
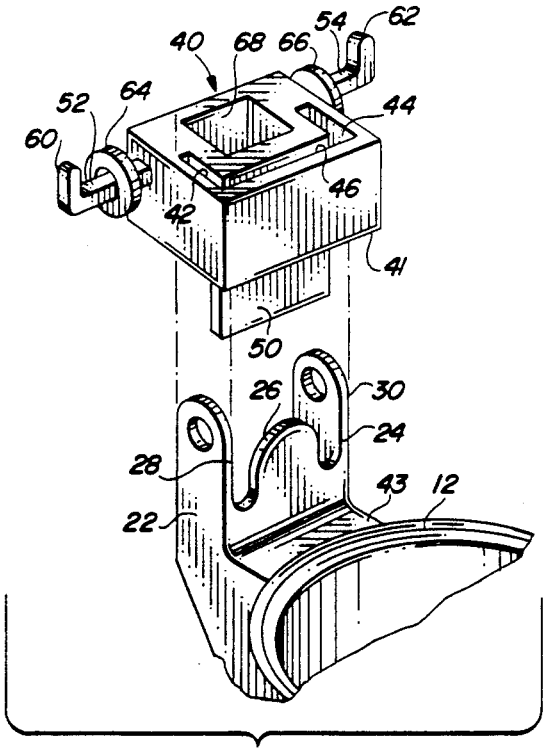
FIG. 2 is a partial isometric view illustrating mounting of the adapter.

Referring to FIG. 1, there is shown a representative valve seat unit 10 manufactured by American Standard as part of its disc cylinder valve and used in conjunction with an associated specially designed flapper valve assembly (not shown). A valve seat 12 includes a depending threaded conduit 14 for engagement with the discharge pipe associated with the toilet tank in which the flapper valve assembly is mounted. A nut 16 and other elements are incorporated to effect robust mechanical attachment and a water tight seal. A housing 18 extends laterally from beneath the valve seat. It supports a conventionally operating stand pipe 20, which stand pipe is in fluid communication with the valve seat assembly downstream of the valve seat through housing 18. A pair of uprights 22, 24 (see also FIG. 2) extend upwardly from a location adjacent valve seat 12. A web 26 interconnects front edges 28, 30 of uprights 22, 24, respectively. The top end of the web is disposed below the upper end of the uprights.

Figure 3:
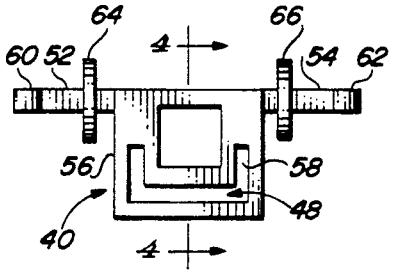
FIG. 3 is a top view of the adapter.

Adapter 40 is configured to penetrably receive uprights 22, 24 and web 26 and through such engagement be positionally fixed with respect to valve seat unit 10 after the associated specially designed flapper valve (not shown) has been removed. Further details attendant adapter 40 will be described with primary reference to FIGS. 2, 3 and 4. The adapter includes a first slot element 42 extending through the adapter for receiving upright 22. A similar slot element 44 extends through the adapter for receiving upright 24. A further slot element 46 penetrably receives at least a portion of web 26. In the preferred embodiment, slot elements 42, 44 and 46 define a U shaped passageway 48, as particularly illustrated in FIG. 3.

Figure 4:
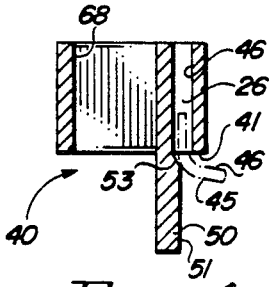
FIG. 4 is a cross sectional view taken along lines 4—4, as shown in FIG. 3.

The vertical positioning of the adapter to place the pivotally attached flapper valve at the correct height and angular orientation with respect to valve seat 12 is controlled by forcing adapter 40 downwardly until edge 41 bears against horizontal member 43 between uprights 22, 24. As shown in FIG. 4, web 26 extends upwardly from member 43 through a 90° arc segment 45. A brace 50 extends downwardly from adapter 40 from a location adjacent the lower opening defining slot element 46. Front surface 51 of the brace includes a horizontally extending arced segment 53 curved to mate with the outer surface of arc segment 45. Accordingly, the brace extends somewhat beneath horizontal surface 43. The engagement of the brace with the horizontal surface tends to restrain upward movement of the adapter and tends to maintain the adapter positionally locked in place.

Brace 50 also serves another purpose. In one of the configurations of the American Standard disc cylinder valve, horizontal member 43 is too low with respect to the valve seat to permit edge 41 to rest thereagainst. To place adapter 40 at the correct height for operation of an attached flapper valve 36, reliance is placed upon the length of brace 50. In this particular American Standard disc cylinder valve, a shelf extends radially outwardly with respect to valve seat 12 from web 26 and between uprights 22, 24. The position of this shelf is positionally fixed with respect to the valve seat and the shelf is used as an index with respect to positioning the adapter. Upon mounting of the adapter upon the uprights and the web, the adapter is slid downwardly until further movement is precluded by interfering engagement between brace 50 and the shelf. Thus, by carefully setting the length of the brace, the mounted height of the adapter with respect to the valve seat can be set and regulated.

Adapter 40 includes a pair of trunnions 52, 54 extending from opposed sides 56, 58. These trunnions penetrably engage apertures 32, 33 of arms 34, 35 extending from a replacement flapper valve 36. A chain or other coupling 37 is secured to the flapper valve via an ear 38 to permit raising of the flapper valve in the conventional manner to effect flushing. From this description it will become apparent that trunnions 52, 54 pivotally mount flapper valve 36 and define the pivot axis for the flapper valve.

A pair of tabs 60, 62 extend upwardly from the extremities of trunnions 52, 54, respectively, to restrain disengagement of arms 34, 35 of flapper valve 36 during normal use. A pair of flanges 64, 66, which may be disc like, are mounted upon trunnions 52, 54, respectively, to positionally retain arms 34, 35 upon the trunnions.

Preferably, adapter 40 is fabricated from flexible and resilient plastic or rubber like material to permit ease of mounting and gripping retention upon the pair of uprights. The configuration of the adapter is such that it may be formed as a monolithic unit. Thereby, it may be molded at relatively low per unit cost. During molding, shrinkage is usually a problem. A cavity or passageway 68 may be formed therein to eliminate unnecessary material and to minimize shrinkage and deformation during cooling.

It may be noted that the height of uprights 22, 24 and web 26 is irrelevant to mounting and use of adapter 40. That is, the adapter can be slid downwardly along the pair of uprights and the web to a location which provides proper and effective seating of flapper valve 36 upon valve seat 12. Thereby, even though valve seat units 10 of the type made by American Standard may have different length pairs of uprights, adapter 10 is capable of fitting all of them and will permit use of after market relatively inexpensive replacement flapper valves.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

We claim:

1. An adapter for pivotally mounting a flapper valve upon a pair of uprights extending from a valve seat for a discharge pipe of a toilet tank, said adapter comprising in combination:

(a) a body having opposed sides;

(b) a pair of trunnions extending from the opposed sides of said body for pivotally supporting a pair of apertured arms extending from the flapper valve;

(c) a passageway extending through said body for receiving and grippingly engaging the pair of uprights of the valve seat to mount and to retain said body on the pair of uprights, said passageway including at least first and second slot elements for penetrably receiving the uprights of the valve seat, each of said first and second slot elements having a cross section corresponding with the respective one of the pair of uprights; and (d) a web extending between the pair of uprights of the valve seat and said passageway including means for accommodating penetration of the web into said body.

2. The adapter as set forth in claim 1 wherein said first and second slot elements extend from opposed sides of said accommodating means.

3. The adapter as set forth in claim 1 wherein said accommodating means comprises a third slot element interconnecting with said first and second slot elements.

4. The adapter as set forth in claim 3 wherein each trunnion of said pair of trunnions includes a transversely extending tab for retaining the respective arm of the flapper valve.

5. The adapter as set forth in claim 4 wherein each trunnion of said pair of trunnions includes a flange for limiting movement of the respective arm of the flapper valve away from the respective one of said tabs.

6. The adapter as set forth in claim 5 wherein said adapter is a monolithic unit.

7. The adapter as set forth in claim 6 wherein said adapter is fabricated of flexible resilient material.

8. The adapter as set forth in claim 1 including a brace depending from said body for bearing against the lower end of the web to restrain removal of said adapter.

9. The adapter as set forth in claim 1 wherein said first and second slot elements comprise slots extending through said body.

10. The adapter as set forth in claim 1 including a brace for limiting the downward movement of said adapter along the uprights and the web.

11. An adapter for pivotally mounting a flapper valve upon a pair of uprights having a web partly disposed between corresponding edges of the uprights, which uprights extend from a valve seat for a discharge pipe of a toilet tank, said adapter comprising in combination:

(a) a body having opposed sides;

(b) a pair of trunnions extending from the opposed sides of said body for pivotally supporting a pair of apertured arms extending from the flapper valve; and (c) a passageway extending through said body for receiving and grippingly engaging the pair of uprights and at least a section of the web to mount and to retain said body with respect to the valve seat.

12. The adapter as set forth in claim 11 wherein said passageway includes a slot extending through said body for receiving the two uprights and at least a segment of the web.

13. The adapter as set forth in claim 12 wherein said slot includes first and second slot members configured in cross section to receive respective ones of the uprights and a third slot member interconnecting said first and second slot members for receiving the web.

14. The adapter as set forth in claim 13 wherein a shelf extends from the web and the uprights and including a brace depending from said body to contact the shelf upon mounting of said adapter and thereby limit further downward movement of said adapter.

15. The adapter as set forth in claim 13 including a brace depending from said body for engaging a section of the web to restrain upward movement of said adapter.

16. The adapter as set forth in claim 15 wherein said brace depends from said body from a location adjacent an edge of said third slot member.

17. The adapter as set forth in claim 16 wherein said first, second and third slot members define in cross section a U shaped passageway.

18. The adapter as set forth in claim 16 wherein said adapter is a monolithic unit.

* * * * *